United States Patent [19]

Suzuki et al.

[11] Patent Number: 4,676,675

[45] Date of Patent: Jun. 30, 1987

[54] MEDIA THICKNESS COMPENSATING DEVICE FOR A PRINTER

[75] Inventors: Yoshihumi Suzuki, Ena; Noritsugu Ito, Tita; Kazuhiro Omura, Aiti, all of Japan

[73] Assignee: Brother Kogyo Kabushiki Kaisha, Nagoya, Japan

[21] Appl. No.: 731,659

[22] Filed: May 7, 1985

[30] Foreign Application Priority Data

May 29, 1984 [JP] Japan ..... 59-109126

[51] Int. Cl.[4] ..... B41J 7/92; B41J 11/20

[52] U.S. Cl. ..... 400/56; 400/59; 338/114

[58] Field of Search ..... 338/114; 400/56–60

[56] References Cited

U.S. PATENT DOCUMENTS

| | | | |
|---|---|---|---|
| 3,750,792 | 8/1973 | Liles | 400/56 |
| 3,875,434 | 4/1975 | Harden et al. | 338/114 |
| 3,983,803 | 10/1976 | Thomas | 400/56 |
| 4,010,834 | 3/1977 | Linder | 400/59 |
| 4,024,940 | 5/1977 | Hendrischk et al. | 400/59 |
| 4,088,215 | 5/1978 | Bader | 400/59 |
| 4,173,927 | 11/1979 | Van Kempen et al. | 400/56 |
| 4,174,908 | 11/1979 | Wehler | 400/56 |
| 4,233,895 | 11/1980 | Wehler | 400/56 |
| 4,322,983 | 4/1982 | Sado | 338/114 |

FOREIGN PATENT DOCUMENTS

| | | | |
|---|---|---|---|
| 124724 | 10/1975 | Japan . | |
| 64229 | 5/1977 | Japan . | |
| 106918 | 9/1977 | Japan . | |
| 124195 | 10/1977 | Japan . | |
| 124196 | 10/1977 | Japan . | |
| 81920 | 6/1979 | Japan . | |
| 7070 | 2/1982 | Japan . | |
| 96868 | 6/1982 | Japan | 400/56 |
| 163588 | 10/1982 | Japan | 400/56 |
| 53465 | 3/1983 | Japan | 400/56 |
| 59-090 | 4/1983 | Japan | 400/56 |
| 205785 | 11/1983 | Japan . | |
| 54583 | 3/1984 | Japan | 400/56 |
| 1138613 | 1/1969 | United Kingdom | 338/114 |

*Primary Examiner*—William Pieprz

*Attorney, Agent, or Firm*—Jordan B. Bierman

[57] ABSTRACT

A media thickness compensating device for a printer which senses the thickness of each record medium, e.g., a printing sheet, mounted on a platen to maintain a proper printing gap between the record medium and a print head. In this device, sensing means including a pressure-sensitive conductive rubber member is disposed so as to be movable toward and away from the platen. The movement of the print head is compensated in accordance with the displacement of the sensing means moved from a reference position to a position where the sensing means comes into contact with the record medium to cause the resistance of the pressure-sensitive conductive rubber member to reach a predetermined reference value. Thus, the printing gap can be kept proper at all times.

13 Claims, 9 Drawing Figures

MEDIA THICKNESS COMPENSATING DEVICE FOR A PRINTER

BACKGROUND OF THE INVENTION

The present invention relates to a printer for printing on record media such as printing sheets on a platen while moving a carriage with a print head thereon along a line of printing parallel to the platen, and more specifically to a media thickness compensating device for a printer which senses the thickness of the record media to maintain a proper printing gap between record media and print head.

Among printers of this type, matrix printers of an impact type are generally known which are suitably used with, for example, data processing systems. In these matrix printers, the operating stroke of printing wires of the print head is so short that resulting prints will be subject to unevenness in visual density or record media will not be able to be fed smoothly unless the relationshp between the print head and the record media on the platen is kept constant. The record media may have various thicknesses, including a single thin sheet, journal paper formed of a plurality of superposed thin sheets, bankbook, etc. It is therefore necessary to compensate the position of the print head in accordance with the change of the thickness of the record media.

To this end, it is necessary first to sense the thickness of the record media. Thereupon, various printers have conventionally been proposed which are provided with a media thickness compensating device.

Referring now to FIG. 1, one such prior art printer will be described. When mounted on a platen 1, a record medium 2 is in contact with a detection roller 4*a* of a potentiometer 4 which constitutes a media thickness compensating device mounted on a carriage 3 which can traverse on a guide shaft 3*a* along a line of printing. Thus, the thickness of the record medium 2 is grasped as the electric resistance of the potentiometer 4. In response to a change of the resistance, a motor 5 on the carriage 3 is driven in either direction. The drive of the motor 5 is transmitted to a support base 8 by means of a drive transmission mechanism which consists of a pinion 6 and a rack member 7. A print head 9 on the support base 8 is compensatorily moved toward and away from the record medium 2 so that a proper printing gap is defined between the record medium 2 and the print head 9.

A device having the same construction as aforesaid is disclosed in, for example, Japanese Patent Publication No. 57-7070.

In the prior art arrangement described above, however, the detection roller 4*a* of the potentiometer 4 is continually in contact with the record medium 2, so that the record medium 2 may suffer the trace of the roller 4*a* or creases or may fail to be fed smoothly. Moreover, the use of the potentiometer would increase the manufacturing cost of the compensating device.

Among other prior art devices subject to like disadvantages are those disclosed in Japanese Patent Disclosure Nos. 57-163588 and 58-205785 and U.S. Pat. Nos. 4,010,834 and 4,024,940. In the device disclosed in Japanese Patent Disclosure No. 58-205785, for example, a mechanism is provided which shifts the detection roller to a position off the record media to protect the record media from the trace of the roller where carbonless duplicating paper is used for the record media. Naturally, therefore, it is not to be desired that the detection roller should continually be pressed against the record media.

In compensating devices of the so-called contact type in which the printing gap is compensated by pressing a sensing element, such as a detection roller, against record media, the reference position of the sensing element is defined as the position where the sensing element is in contact with the surface of the record media. A proper printing gap is obtained by moving the print head in the reference position away from the platen over a predetermined distance.

One such device is disclosed in Japanese Patent Disclosure No. 50-124724.

In this case, although the printing gap can be set optionally, the actual thickness of the record media cannot be sensed because the distance between platen and print head or sensing element is unknown. Therefore, the printing gap cannot be set with higher accuracy.

On the other hand, compensating devices disclosed in Japanese Patent Disclosure No. 54-81920 and U.S. Pat. Nos. 3,750,792 and 4,174,908 are subject to a drawback that the mechanical structure of the sensing section is complicated, resulting in increased manufacturing cost and difficulty in maintenance. Also, compensating devices disclosed in Japanese Patent Disclosure No. 52-106923 and U.S. Pat. No. 4,088,215 are complicated in structure, using a Hall-effect transducer and potentiometer for circuit means. These compensating devices are designed so that the sensing element is continually in contact with record media, and are subject to the same disadvantages as aforesaid. Further, an optical compensating device disclosed in Japanese Patent Disclosure No. 52-106918 requires a special compensating means to counter the influence of temperature change of the light source. According to Japanese Patent Disclosure No. 52-64229, furthermore, thickness data is previously recorded on each individual page of record media so that the print head is set to match pages of various thicknesses. In this case, the thickness data must be recorded on the record media without omission, so that the record media handled should inevitably be limited in types.

SUMMARY OF THE INVENTION

The object of the present invention is to provide a media thickness compensating device for a printer capable of more accurately sensing the thickness of record media without continually keeping sensing means in contact with the record media and hence of setting a proper printing gap with higher accuracy, simple in construction, permitting reduced manufacturing cost, and improved in durability and reliability.

In order to achieve the above object, according to the present invention, a pressure-sensitive conductive element with its electric resistance variable with external pressure is basically used for sensing means. Typically, the pressure-sensitive conductive element is made of a pressure-sensitive conductive rubber material which is formed by mixing silicone rubber with conductive particles of graphite and/or metal, for example. The pressure-sensitive conductive element is moved toward a platen by moving means to be brought into contact with a record medium on the platen only in sensing the thickness of the record medium. A pressure produced by such contact indicates that the electric resistance of the pressure-sensitive conductive element has reached a reference value. The displacement of the print head is controlled for a proper printing gap between record medium and print head in accordance with the displacement of the sensing means moved until the detection.

The pressure-sensitive element is conventionally known which is made of a material formed by mixing an elastic material, such as synthetic resin or rubber, with fine conductive particles of metal or the like so that its electric resistance varies with external pressure. The method of manufacture and the structure of the pressure-sensitive conductive element are stated in Japanese Patent Disclosure Nos. 52-124195 and 52-124196.

The pressure-sensitive conductive element of this type is advantageous in being compact, light in weight, less susceptible to temperature change, stable in action, and less expensive. In consideration of these advantages, the present invention uses the pressure-sensitive conductive element as the principal component of the compensating device. Thus, even though the sensing means is mounted on a carriage, the inertial mass of the whole carriage may be made smaller than in the conventional case. Therefore, a motor for driving the carriage does not require a great torque, facilitating miniaturization of the printer.

According to the present invention, moreover, the reference position of the sensing means, which moves toward and away from the platen in a direction perpendicular thereto, is set with respect to the position of the platen. Therefore, the reference position can always be determined accurately. Thus, the accuracy of detection of the record media thickness is improved, so that the printing gap of the print head can be set more accurately.

The sensing means touches the record media only during sensing operation, and its contact pressure is low. Accordingly, the record media will be protected from creases or traces, and the feed of the record media will not be impeded.

In a preferred embodiment of the present invention, an initial pressure lower than the pressure corresponding to the reference value may be previously applied to the pressure-sensitive conductive element. Thus, the action of the pressure-sensitive conductive element is further stabilized to improve the accuracy of the sensing operation.

Also, an arrangement may be proposed in which the initial pressure can be adjusted. To this end, the pressure-sensitive conductive element, along with a pair of electrode elements, is attached to one end portion of a threaded support member. The support member is screwed into a bracket member by manual operation with the aid of an operating groove formed at the other end of the support member. Moreover, a proper initial pressure is produced by pressing the pressure-sensitive conductive element against a contact member which, formed of e.g. a leaf spring, is sandwiched between one of the electrode plates and record media.

Absence of record media can be detected by moving the sensing means of the invention toward the platen with no record media thereon. Enjoying this additional function to detect the presence of record media, the compensating device of the invention obviates the necessity of any separate detecting means for this purpose.

BRIEF DESCRIPTION OF THE DRAWIGNS

These and other objects and advantages of the present invention will be more completely described below with reference to the accompanying drawings, in which.

Figure 1:
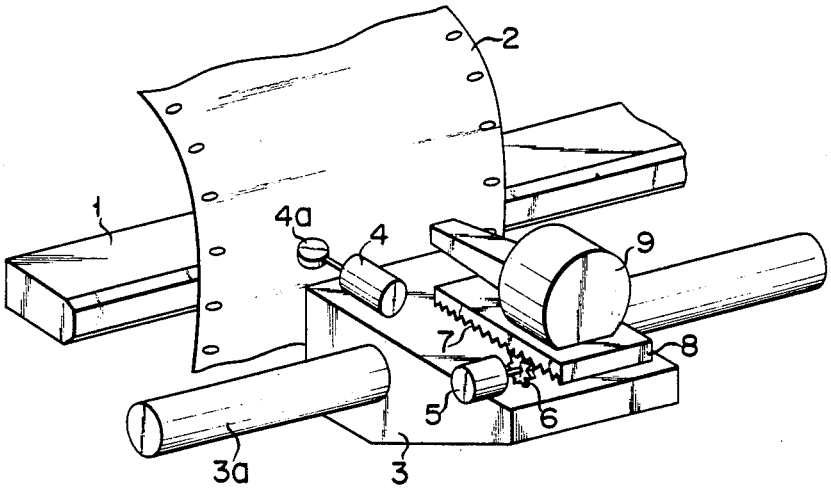
FIG. 1 (PRIOR ART)
FIG. 1 is a schematic perpective view of a prior art printer with a media thickness compensating device.

Referring now to the drawings of FIGS. 2 to 9, a prefered embodiment of the present invention will be described in detail.

DETAILED DESCRIPTION OF THE PREFERRED EMBODIMENT

Figure 2:
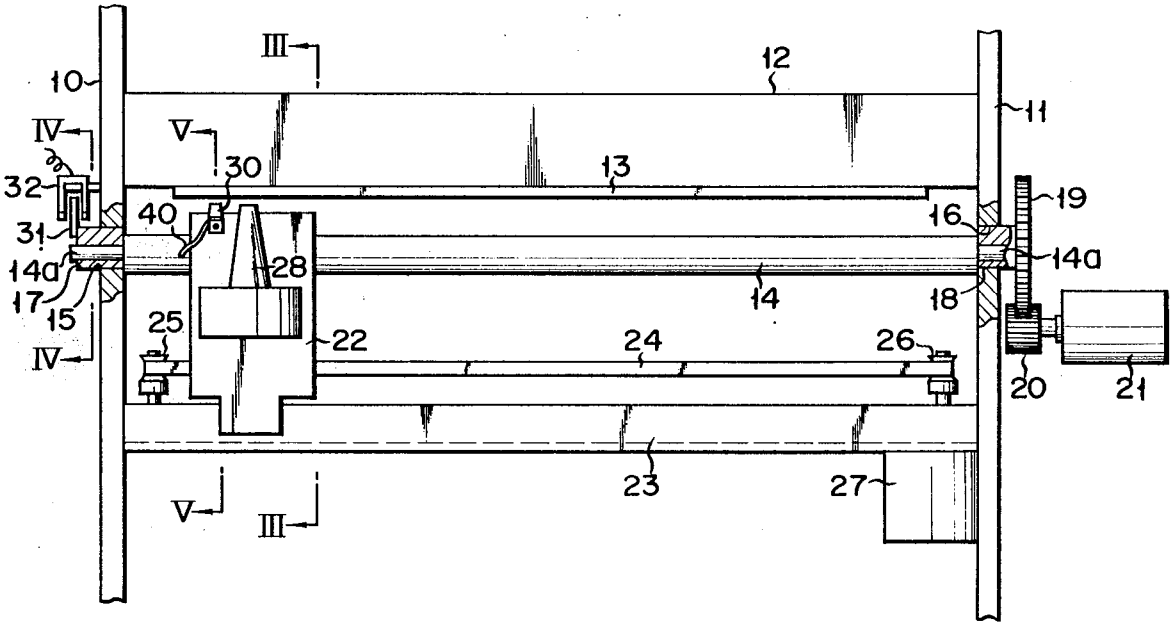
FIG. 2 is a plan view partially in section showing a printer with a media thickness compensating device according to the present invention.

In this embodiment, as shown in FIG. 2, a dot matrix printer is disclosed as a printer. A platen 12 is fixed between a pair of side plates 10 and 11 which constitute the machine frame of the printer, and a record medium 13 is supported on the platen 12. A guide shaft 14 is disposed in front of (or below as illustrated) the platen 12, extending parallel thereto and at a distance therefrom. Two end portions 14*a* of the guide shaft 14 are eccentrically fixed to eccentric bearing members 17 and 18, individually, which are rotatably fitted in supporting holes 15 and 16 in the side plates 10 and 11, respectively.

The right-hand eccentric bearing member 18 is formed integrally with a driven gear 19, which is in mesh with a driving gear 20 fixed to a motor shaft. The guide shaft 14 is operatively coupled to a stepping motor 21 by means of the gears 19 and 20 which constitute a gear transmission mechanism. The motor 21 is set in a suitable position in the printer. Illustration of the way the motor 21 is mounted is omitted.

As the stepping motor 21 rotates, an eccentric rotatory motion is transmitted to the guide shaft 14 by means of the left- and right-hand eccentric bearing members 17 and 18. As a result, the guide shaft 14 can move toward or away from the platen 12 over a distance within a fixed range corresponding to the eccentricity, while normally maintaining the parallel relation with the platen 12.

A carriage 22 is supported on the guide shaft 14 so as to be slidable along the same, and is guided by a guide rail 23 which is disposed in front of the shaft 14 in parallel relation.

An endless driving belt 24 is fixed to the carriage 22 and passed around a pair of pulleys 25 and 26 arranged on either side. The right-hand pulley 26 is rotated by a reversible carriage drive motor 27. The driving force of the pulley 26 is transmitted to the carriage 22 through the belt 24, so that the carriage 22 slides on the guide shaft 14.

A print head 28 is mounted on the carriage 22. The head 28 is of a wire-dot matrix type whose tip end portion extends toward the platen 12, defining a printing gap between itself and the record medium 13 on the platen 12.

As the carriage 22 slides, the print head 28 traverses therewith along a line of printing on the platen 12.

Besides the print head 28, sensing means 30 constituting the principal part of the media thickness compensating device of the present invention is disposed on the carriage 22. As shown in FIG. 2, the sensing means 30 is attached to that edge of the carriage 22 facing the platen 12, located on the left of the print head 28.

Figure 4:
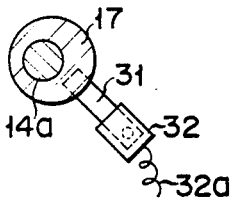
FIG. 4 is a partial enlarged view of position detecting means taken along line IV—IV of FIG. 2.

A detectable member 31 is fixed to the end face of the left-hand eccentric bearing member 17, and a position sensor 32 is supported on the side plate 10 correspondingly. The sensor 32 is a conventional photosensor which consists of a light emitting element and a light receiving element. A position detection signal is delivered from the sensor 32 when the detectable member 31 passes between the two elements to intercept the optical path. FIG. 4 shows the positional relationship in this state. The position detection signal is delivered only when the sensing means 30 is located in a reference position at a predetermined distance from the platen 12. The position sensor 32 and the detectable member 31 constitute position detecting means for the sensing means 30.

The position detection signal is electrically connected to a control system (mentioned later) of the media thickness compensating device by means of a wire **32*a* (FIG. 4**).

Figure 3:
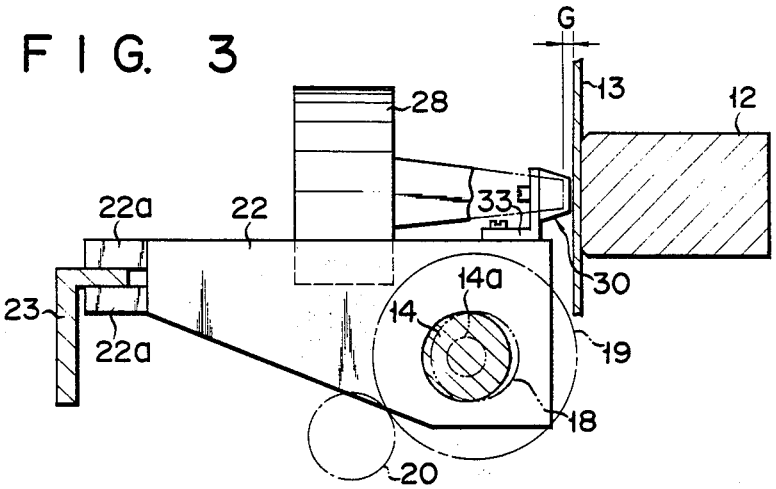
FIG. 3 is an enlarged side sectional view of the principal part of the printer taken along line III—III of FIG. 2.

In FIG. 3, the carriage 22 is provided with a forked pair of engaging portions **22*a* which engage the guide rail 23 so as to hold it between them. Thus, the carriage 22 is guided for movement relative to the platen 12 in the direction of the line of printing parallel to the platen 12 in a direction perpendicular to the printing line. As seen from FIG. 3 showing the eccentric positional relationship between the guide shaft 14 with the carriage 22 slidably fitted thereon and the eccentric bearing member 18 (indicated by chain line) eccentric to the guide shaft 14, the carriage 22, along with the print head 28 and the sensing means 30 thereon, moves relatively to the platen 12 over a fixed range in a horizontal direction perpendicular to the printing line as the guide shaft 14 moves relatively to the platen 12 over the same fixed range. As a result, the distance between the sensing means 30 and the record medium 13 on the platen 12 changes, and the distance between the print head 28 and the record medium 13**, i.e., printing gap G, also changes.

The reference position of the sensing means 30 can be set in any position within its range of transfer. In this embodiment, it is adjusted to one end of the transfer range, that is, the motion limit end farthest from the platen 12.

As shown in FIG. 3, the sensing means 30 is set on the carriage 22 so as to project a short distance from the print head 28 toward the platen 12. Accordingly, even when the sensing means 30 advances toward the platen 12 or the record medium 13 thereon to contact therewith, the print head 28 is kept from directly touching them. Thus, print wires narrowly exposed at the tip end of the print head 28 are prevented from coming into contact with the record medium 13.

The sensing means 30 includes an L-shaped supporting bracket member 33 bolted to the upper surface of the carriage 22. The principal part of the sensing means 30 is attached to an upright portion of the supporting bracket member 33.

Figure 5:
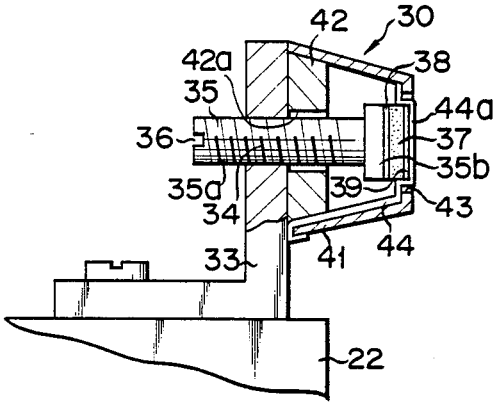
FIG. 5 is an enlarged side sectional view of the principal part of sensing means taken along line V—V of FIG. 2.

Referring now to FIG. 5, the construction of the sensing means 30 will be described in detail. The bracket member 33 is formed with a tapped hole 34 in which is screwed a bolt-shaped support member 35 with a screw **35*a*. The support member 35 projects horizontally toward the platen 12, and its projecting end 35*b* constitutes a mounting portion. The other end portion of the support member 35 is formed with an operating groove 36 whereby the support member 35** can be manually turned by means of a screwdriver.

The mounting portion **35*b* is fitted with a pressure-sensitive conductive element 37 and a pair of electrode plates 38 and 39 arranged longitudinally between which the element 37** is sandwiched. The fitting is accomplished by means of, e.g., an adhesive agent.

The pressure-sensitive conductive element 37 tends to change its electric resistance in dependence on an external force applied thereto, if any. In this embodiment, filmy pressure-sensitive conductive rubber is used as the material for the element 37. This material is selected among ones prepared by mixing silicone rubber with conductive particles consisting of graphite and/or metal at a prescribed mixture ratio.

The electrode plates 38 and 39 are electrically connected to the control system of the media thickness compensating device by means of wires 40 (FIG. 2).

A cap member 41 entirely covering the element 37 and the electrode plates 38 and 39 is attached at its proximal end portion to the bracket member 33 by means of a base member 42. The base member 42 is fixed to the upright portion of the bracket member 33 by using, e.g., an adhesive agent, and is formed with a bore **42*a* penetrated by the support member 35. A window 43 is formed at the head portion of the cap member 41. A leaf spring plate 44 is provided so that its proximal end portion is fixedly sandwiched between the cap member 41 and the base member 42. The leaf spring plate 44 includes a contact portion 44*a* which extends along the inner surface of the cap member 41 and is partially exposed to the outside through the window 43. The distal end of the leaf spring plate 44 engages the inside of the upper edge of the window 43** with a small urging force.

The contact portion **44*a* is located just close to the one electrode plate 39. In other words, the contact portion 44*a* is disposed between the electrode plate 39 and the record medium 13 to constitute a contact member which is directly in contact with the record medium 13. A pressure applied to the contact portion 44*a* is transmitted to the pressure-sensitive conductive element 37**.

The support member 35 is manually turned and screwed in with use of, e.g., a screwdriver held against the operating groove 36. Thus, the support member 35 is moved toward the contact portion **44*a* so that the pressure-sensitive conductive element 37 is pressed against the contact portion 44*a* to be subjected to an initial pressure. By doing this, the pressure-sensitive conductive element 37** can keep its electric resistance stable without being distorted by a slight external contact pressure.

In setting the record medium 13 on the platen 12, for example, the record medium 13 may sometimes touch the sensing means 30. In such a situation, the element 37 can be prevented from being actuated. To this end, it is to be desired that the initial pressure should be set to a higher level than the pressure caused by such contact with the record medium 13. The initial pressure can be freely adjusted by changing the depth of thread engagement of the support member 35.

FIG. 5 is a graph showing the change of electric resistance of the pressure-sensitive conductive rubber as the material for the pressure-sensitive conductive element 37, which is formed by mixing silicone rubber with conductive particles of graphite and/or metal, as compared with external pressure applied to the pressure-sensitive conductive element 37. As seen from the graph, the resistance decreases R1, R2, . . . as the pressure increases F1, F2, . . .

When the carriage 22 moves toward the platen 12, the contact portion 44*a* of the sensing means 30 comes directly into contact with the record medium 13 on the platen 12, and a pressure is applied to the pressure-sensitive conductive element 37 through the contact portion 44*a* to change the electric resistance of the element 37.

Figure 7:
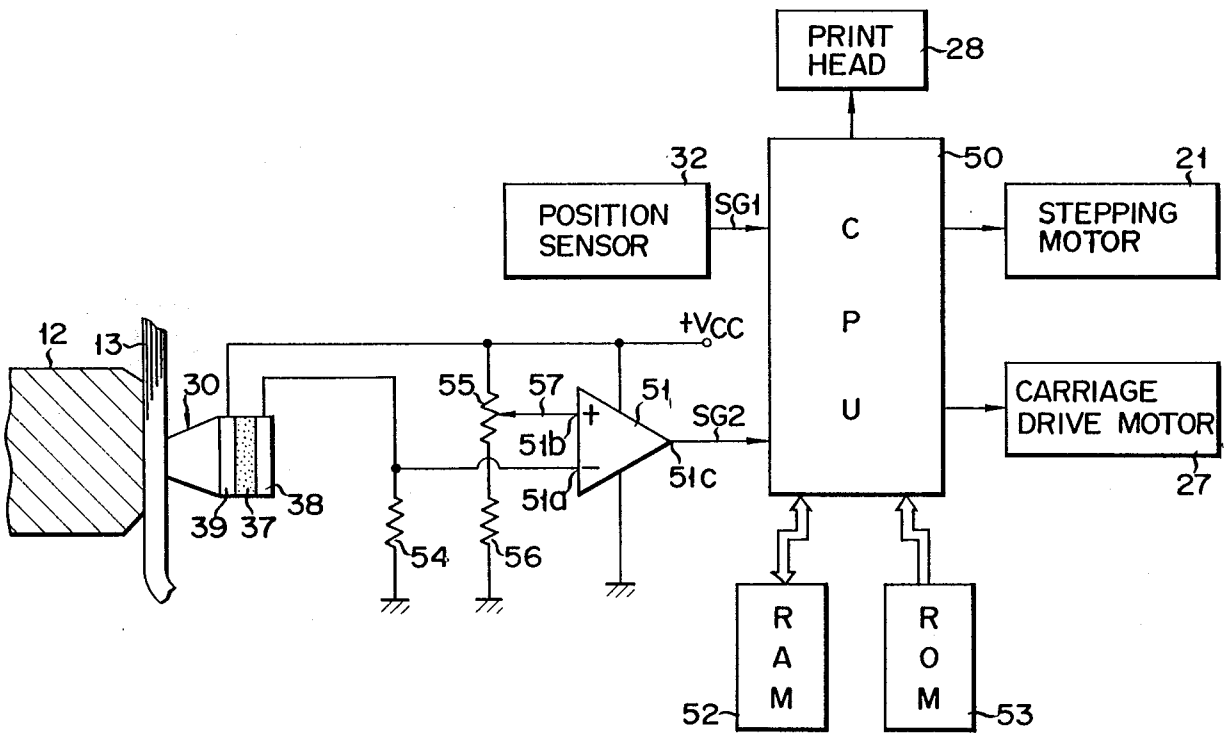
FIG. 7 is a circuit diagram of a control system of the media thickness compensating device of the invention.

Referring now to the circuit diagram of FIG. 7, the circuit arrangement of the control system in the compensating device for controlling the sensing means 30 will be described.

A central processing unit (hereinafter referred to as CPU) 50 is connected with the stepping motor 21, the carriage drive motor 27, the position sensor 32 constituting the principal part of the position detecting means, a comparator 51, a random access memory (hereinafter referred to as RAM) 52, and a read-only memory (hereinafter referred to as ROM) 53.

The CPU 50 receives a position detection signal SG1 from the position sensor 32 and thereafter determines the displacement of the sensing means 30 toward the platen 12 from the reference position at the one end of the transfer range farthest from the platen 12 by counting the driving pulses of the stepping motor 21.

The one electrode plate 39 of the sensing means 30 is connected to a power source, while the other electrode plate 38 is grounded through a resistor 54. The junction of the electrode plate 38 and the resistor 54 is connected to an inverted input terminal 51*a* of the comparator 51. Thus, the change of the electric resistance of the pressure-sensitive conductive element 37 is applied as a voltage change to the inverted input terminal 51*a*.

One terminal of a variable resistor 55 is connected to the power source, while the other terminal is grounded through a resistor 56. A variable terminal 57 of the variable resistor 55 is connected to a noninverted input terminal 51*b* of the comparator 51.

Thus, a voltage applied to the noninverted input terminal 51*b* of the comparator 51 can be varied by manually turning a control knob (not shown) of the variable resistor 55.

The comparator 51 compares voltages applied individually to the inverted and noninverted input terminals 51*a* and 51*b*. When the voltage of the inverted input terminal 51*a* responsive to the change of the electric resistance of the pressure-sensitive conductive element 37 caused when the sensing means 30 is pressed against the record medium 13 reaches the level of the voltage of the noninverted input terminal 51*b* or reference voltage, a media detection signal SG2 is delivered from an output terminal 51*c* of the comparator 51 to the CPU 50. Thus, the comparator 51 constitutes a media detecting means for detecting that the changed electric resistance of the pressure-sensitive conductive element 37 has reached a reference value.

The CPU 50 calculates, as the number of driving pulses of the stepping motor 21, the displacement (value B shown in FIG. 8) from the reference position of the sensing means 30 detected by the position sensor 32 to the detection position of the sensing means 30 where the reference value is detected through the contact between the sensing means 30 and the record media 13, in response to the media detection signal, and causes the RAM 52 to store the value of displacement.

The ROM 53 is previously set to store therein a fixed distance (value A shown in FIG. 8) from the front of the platen 12 to the reference position as the number of driving pulses of the stepping motor 21. During the operation for sensing the record medium 13, the CPU 50 reads and computes stored data in the ROM 53 and data in the RAM 52 related to the displacement of the sensing means 30, thereby calculating the actual thickness (value T shown in FIG. 8) of the record medium 13.

The ROM 53 also stores as data a proper value of the printing gap corresponding to the thickness of the record medium 13. Accordingly, the CPU 50 reads out the value of the proper printing gap corresponding to the calculated value of thickness from the ROM 53, and drives the stepping motor 21 reversely with the number of driving pulses responsive to the printing gap. Thus, the print head 28 is controlled so that it is moved to and stopped at a desired position.

Since the reference position of the sensing means 30 is located at the fixed distance A from the platen 12, as described above, the thickness of the record medium 13 can accurately be calculated. Accordingly, the print head 28 can be moved and stopped on the basis of the calculated value, and the printing gap G can always be maintained properly.

Figure 6:
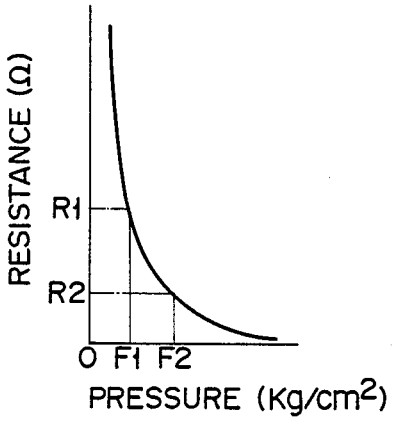
FIG. 6 is a graph showing the change of the electric resistance of a pressure-senisitive conductive element compared with external pressure.
Figure 8:
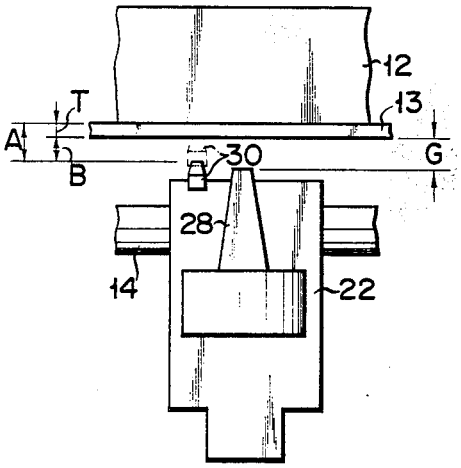
FIG. 8 is a partial plan view of the printer shown in FIG. 2 illustrating relative distances kept during sensing operation for the thickness of record media.

Even though the initial pressure is applied to the pressure-sensitive conductive element 37 of the sensing means 30, as described above, it is set to be lower than the pressure corresponding to the reference value of the electric resistance to be detected. In the graph of FIG. 6, for example, F1 and R1 represent the initial pressure and its corresponding resistance, respectively, and F2 indicates a pressure corresponding to the reference value R2.

Figure 9:
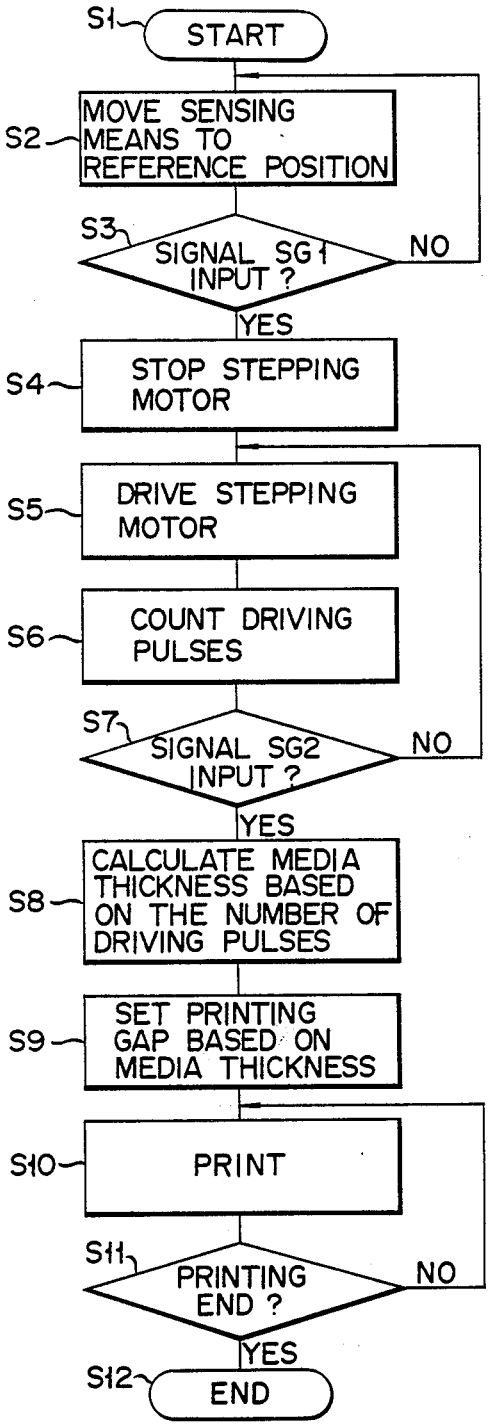
FIG. 9 is a flow chart illustrating a series of steps of sensing operation.

Referring now to the flow chart of FIG. 9, the sensing operation of the media thickness compensating device of the present invention and a subsequent printing operation will be described.

In step S1, the power source is turned on to start the device. In step S2, the sensing means 30, along with the carriage 22, is moved toward the reference position in the direction perpendicular to the line of printing of the platen 12. Thereupon, the sensing means 30 reaches the reference position remotest from the platen 12 within the range of transfer of the sensing means 30. In step S3, the CPU 50 is checked to see if it is supplied with the position detection signal SG1 from the position sensor 32. If the reply is "NO", the transfer of the carriage 22 is continued. If we have "YES" for the answer, the stepping motor 21 is stopped and the sensing means 30 is located in its reference position in step S4.

Subsequently, when the stepping motor 21 is actuated in step S5, the sensing means 30, along with the carriage 22 and the print head 28, advances toward the platen 12 as the guide shaft 14 rotates eccentrically. Meanwhile, the driving pulses of the stepping motor 21 are counted in step S6. In step S7, the CPU 50 is checked to see if it is supplied with the media detection signal SG2 from the comparator 51. If the reply is "NO", the operations in steps S5 and S6 are repeated. If we have "YES", the stepping motor 21 is stopped, and, in step S8, the CPU 50 calculates the actual thickness T of the record medium 13 by subtracting the displacement B from the distance A shown in FIG. 8, in accordance with the number of pulses of the stepping motor 21 counted while the sensing means 30 moves from the reference position to its stop position or detection position.

Then, in step S9, the CPU 50 drives the stepping motor 21 reversely with a predetermined number of driving pulses responsive to the calculated value T, thereby causing the print head 28, along with the carriage 22, to move away from the platen 12. The print head 28 is stopped when it reaches a predetermined position. In this manner, a proper printing gap is automatically defined between the front of the record medium 13 and the tip end face of the print head 28.

Thus, in step S10, a proper impact can be applied to the record medium 13 for clear-cut printing by operating the printing wires of the print head 28 while driving the carriage drive motor 27 to reciprocate the carriage 22 along the line of printing of the platen 12.

Then, in step S11, a decision is made as to whether or not the printing is ended. If we have "NO" for the answer, the printing operation is continued. If we have "YES", step S12 is entered, in which the printing operation is ended.

If the sensing means 30 is moved toward the platen 12 when no record medium is set on the platen 12, the distance from the platen 12 to the reference position equals the displacement of the sensing means from the reference position, so that the calculated value from the CPU 50 becomes zero. Thus, absence of record media can be detected.

This indicates that the device of the invention enjoys a function to detect the presence of record media without any special provision therefor.

When continuously printing on a plurality of record media of the same thickness, a proper printing gap can be determined directly from the reference position on condition that the record media are not on the platen 12 by previously setting the RAM 52 to store the minimum detected thickness. Thus, sensing processes for the second record medium and ones subsequent thereto can be omitted for improved printing efficiency.

Since the reference position of the sensing means 30 is the remotest position from the platen 12 in the range of transfer, a sufficiently wide gap can normally be maintained between the record medium 13 and the print head 28, facilitating insertion of the record medium 13.

In the embodiment described above, the initial pressure is applied to the pressure-sensitive conductive element 37. Alternatively, however, the contact member directly in contact with the record medium 13 may be fixed to the one electrode plate 39 so that no initial pressure is applied.

Moreover, the sensing means 30 may be provided independently of the carriage 22 instead of being mounted thereon.

Thus, it is to be understood that the present invention is not limited to the above embodiment.

What is claimed is:

1. In a printer which includes a platen capable of carrying thereon record media of various thicknesses, a carriage, a print head mounted on the carriage, tranverse means for traversing the carriage along the platen, whereby the print head can print on the record media along a line of printing of the platen, said print head being movable in a direction perpendicular to the line of printing, and a media thickness compensating device for sensing the thickness of the record media on the platen, said media thickness compensating device comprising:

sensing means including a presure-sensitive conductive element whose electric resintance varies in response to an external pressure applied thereto;

moving means for moving the sensing means in a direction perpendicular to the line of printing to bring the sensing means into contact with the record media, whereby the pressure-sensitive conductive element of the sensing means has a changed electric resistance;

means for detecting that the changed electric resistance of the pressure-sensitive element of the sensing means has reached a predetermined reference value; and control means for controlling the displacement of the print head in accordance with the displacement of the sensing means by the moving means up to the position for the detection, thereby setting the gap between the record media and the print head, said sensing means further includes a pair of electrode plates in contact with the pressure-sensitive conductive element so that the element is sandwiched between the electrode plates, a support member having at one end a mounting portion for holding the electrode plate and the pressure-sensitive conductive element, a contact member disposed between one of the electrode plates and the record media so as to be able to be directly in contact with the record media, a bracket member threadably fitted with the support member, and an operating groove formed at the other end of the support member, whereby the support member is manually screwed in the bracket member, so that the screwing action of the support member, in conjunction with the contact member, causes an adjusted initial pressure lower than a pressure corresponding to the reference value to be applied to the presure-sensitive conductive element.

2. A printer as claimed in claim 1, wherein said bracket member is fixedly mounted on the carriage.

3. In a printer which includes a platen capable of carrying thereon record media of various thicknesses, a carriage having a print head mounted thereon, said print head performing a printing operation acting on the record media, traverse means for traversing the carriage along the platen, whereby the print head can print on the record media along a line of printing of the platen, said print head being movable in a direction perpendicular to the line of printing, and a media thickness compensating device for performing a sensing operation so as to sense the thickness of the record media on the platen, said media thickness compensating device comprising:

sensing means including a pressure-sensitive conductive element whose electric resistance varies in response to an external pressure applied thereto to produce a changed electric resistance;

moving means for moving the sensing means toward the platen to engage the sensing means with the record media only during the sensing operation thereby causing the pressure-sensitive conductive element to produce the changed electric resistance;

detecting means operable to detect that the changed electric resistance of the conductive element of the sensing means has reached a predetermined reference value, thereby defining a detection position of the sensing means;

said sensing means being reversed by said moving means from the detection position away from the platen and thereby disengaging from the record media; and control means for controlling the movement of the print head in association with the reversing movement of the sensing means to set a proper gap between the record media and the print head.

4. A printer as claimed in claim 3, wherein said pressure-sensitive conductive element comprises a mixture of a silicone rubber material with conductive particles.

5. A printer as claimed in claim 3, wherein said sensing means is mounted on the carriage in a fixed position relative to the print head, and said moving means moves the carriage toward and away from the platen.

6. A printer as claimed in claim 3, wherein said sensing means projects from the print head toward the platen, so that the print head is prevented from coming into contact with the record media even when the sensing means is in contact with the record media.

7. A printer as claimed in claim 3, wherein said sensing means further includes initial pressure applying means for applying to the pressure-sensitive conductive element a predetermined initial pressure lower than a pressure corresponding to said predetermined reference value thereby keeping the electric resistance of the conductive element stable without it being distorted by slight external contact pressure.

8. A printer as claimed in claim 7, wherein said sensing means further includes adjusting means adapted to adjust the intial pressure of the initial pressure applying means.

9. A printer as claimed in claim 7, wherein said sensing means further includes a pair of electrode plates in contact with the pressure-sensitive conductive element so that the conductive element is sandwiched between the electrode plates, a support member having at one end a mounting portion for holding the electrode plates and the pressure-sensitive conductive element, and a bracket member holding said support member, said initial pressure applying means including a contact member disposed between one of the electrode plates and the record media adapted to be in direct contact with the record media.

10. A printer as claimed in claim 9, wherein said contact member is formed of a leaf spring.

11. In a printer which includes a platen capable of carrying thereon record media of various thicknesses, a carriage having a print head mounted thereon, said print head performing a printing operation on the record media, traverse means for traversing the carriage along the platen, whereby the print head can print on the record media along a line of printing of the platen, said print head being movable in a direction perpendicular to the line of printing, and a media thickness compensating device for performing a sensing operation preceding the printing operation so as to sense the thickness of the record media on the platen, the improvement which comprises said media thickness compensating device comprising:

sensing means having an electric resistance which varies in response to an external pressure applied thereto to provide a changed electrical resistance, said sensing means being able to move toward and away from the platen within a predetermined range of transfer along a direction transverse to the line of printing, said sensing means being fixed with respect to said print head during said printing operation;

moving means for moving sensing means within the range of transfer thereof from a reference position at a predetermined distance remote from the platen toward the platen to bring the sensing means into contact with the record media only during the sensing operation, whereby the pressure-sensitive conductive element of the sensing means has a changed electrical resistance;

position detecting means operable to deliver a position detection signal when the sensing means is in the reference position;

media detecting means operable to deliver a media detection signal when the changed electric resistance of the sensing means has reached a predetermined reference value, thereby defining a detection position of the sensing means;

memory means for storing a fixed distance between the front of the platen and the reference position, and storing a proper printing gap corresponding to the thickness of the record media; and control means for calculating the actual thickness of the record media by subtracting the displacement of the sensing means between the reference position and the detection position from said fixed distance, and controlling the movement of the print head in response to the actual thickness of the record media to stop the print head when the print head reaches a position to define the proper gap between the record media and the print head.

12. A printer as claimed in claim 11, wherein said reference value of electric resistance can be adjusted manually.

13. A printer as claimed in claim 11, wherein the control means detects absence of the record media on the platen when the calculated value of the actual thickness of the record media becomes zero.

* * * * *

UNITED STATES PATENT AND TRADEMARK OFFICE

CERTIFICATE OF CORRECTION

PATENT NO. : 4,676,675

DATED : June 30, 1987

INVENTOR(S) : Yoshihumi Suzuki, et al

It is certified that error appears in the above-identified patent and that said Letters Patent is hereby corrected as shown below:

ON THE TITLE PAGE:

Under Foreign Application Priority Data, please insert --May 9, 1984 Japan 59-92486--.

Signed and Sealed this

Twenty-second Day of December, 1987

*Attest:*

DONALD J. QUIGG

*Attesting Officer*

*Commissioner of Patents and Trademarks*